United States Patent [19]

Kenyon, 2nd

[11] Patent Number: 4,832,201

[45] Date of Patent: May 23, 1989

[54] CUP AND CLOSURE SYSTEM

[75] Inventor: Maynard A. Kenyon, 2nd, Mercerville, N.J.

[73] Assignee: General Foods Corporation, White Plains, N.Y.

[21] Appl. No.: 793,506

[22] Filed: Oct. 31, 1985

[51] Int. Cl.[4] ..... B65D 41/00

[52] U.S. Cl. ..... 206/515; 215/232; 229/123.1

[58] Field of Search ..... 206/515; 229/43; 220/83; 215/232

[56] References Cited

U.S. PATENT DOCUMENTS

| | | | |
|---|---|---|---|
| 3,488,201 | 1/1970 | Pizarro | 229/43 X |
| 3,765,595 | 10/1973 | Bernhardt | 206/515 X |
| 4,209,126 | 6/1980 | Elias | 215/232 X |
| 4,215,797 | 8/1980 | Chen | 229/43 X |
| 4,333,601 | 6/1982 | Grimm | 229/43 |

*Primary Examiner*—Steven M. Pollard

*Attorney, Agent, or Firm*—Thomas R. Savoie; Daniel J. Donovan

[57] ABSTRACT

A container comprising a rigid, injection-molded plastic cup, and an impermeable membrane closure, wherein the angle of divergence of the sidewall of the cup is optimized based upon ease of opening and stackability.

4 Claims, 2 Drawing Sheets

CUP AND CLOSURE SYSTEM

BACKGROUND OF THE INVENTION

This invention relates to a combination cup and closure system wherein dry powdered materials are stored and protected from atmospheric conditions, and in particular, to improvements in the shape of such containers so as to facilitate their opening. Recently there has been a demand for containers to store serving size amounts of powdered materials, and in particular instant beverage mixes. Such containers must protect the powdered materials from the atmosphere, while at the same time being convenient and easy-to-open. One such container was fabricated out of drawn aluminum, but due to the expense alternatives were sought. Plastic was seen as a viable alternative, however, thermo-formed plastic was found to be unacceptable as it was too thin and did not form a sufficient moisture barrier. It was also unacceptable on the production line.

U.S. Pat. No. 4,061,782 to Baxter, discloses a disposable drinking cup body having a lower portion containing a dry beverage ingredient, and a removable cap which hermetically seals a beverage ingredient in the lower portion of the cup body.

U.S. Pat. No. 4,368,818 to Day et al., discloses a stackable thin-walled cup designed to absorb telescoping loads with less risk of jamming and is disclosed for use in beverage dispensing machines with an ingredient held in the cup.

SUMMARY OF THE INVENTION

The present invention provides a rigid, injection-molded plastic container wherein powdered materials, and in particular powdered instant beverage mixes, can be stored. The container is in the shape of a circular cup with a laminated foil membrane as a cover. The cup is made of a rigid, injection-molded plastic, such as a high density polyethylene or polypropylene. The polyethylene is preferred on an economics basis. Contrary to materials previously used to form similar cups, the present plastic material remains rigid and does not deform from pressure; as when held in a hand. The cup must be constructed with a sidewall which is at the optimal angle from the vertical. The factors to be considered in determining the optimal angle are: consumer use, material handling, and infeed indexing, the latter two factors referring to the manufacturing process.

In addition to the above factors, the size and required volume will also play a part in determining the optimal conditions. As the cup increases in size, the ability of the consumer to hold onto the cup becomes easier as there is more surface area to grasp onto.

It was found that a cup with a sidewall that diverged at a small angle was manageable, and did not easily slip from one's grasp when pressure was applied, in fact as the angle decreases, the ease of managability increases. The cups are usually grasped by one's fingertips, due to their size, and this contributes to the problem.

To achieve a moisture barrier, thicker sidewalls are needed due to the use of thermoplastic materials. The thicker sidewalls then require a wider angle from the verticle for ease of stackability on the assembly line. The wider angles result in more cups per unit of stack height by mitigating the effect of the sidewall thickness. The present cups have sidewalls with a thickness of between 0.25 and 0.50 inches, preferably 0.35 inches.

This compares with the foil cups previously used for the same purpose; which had a thickness of 0.004 inch.

Optimization of these two conditions resulted in the present invention, where the sidewalls diverge at an angle of about 11.5° to about 12.5°, preferably 11.8° to 12.2°, with the optimal angle of 12°. It should be noted that some variation in the final angle may result after the cup is removed from the mold.

The powdered material is retained within the cup by a laminated membrane which is hermetically sealed thereto. The membrane is comprised of a lamination of foil, polyethylyne and a heat seal coating. The membrane is easily peelable, and this is possible due to good shear strength and poor tensile strength. In addition, due to its formulation, the membrane is puncture resistant and can therefore more easily withstand the rigors of the distribution environment.

DETAILED DESCRIPTION

In order that the invention may be more clearly understood, reference will now be made to the accompanying drawings which illustrate a number of embodiments of the invention. In the drawings.

Figure 1:
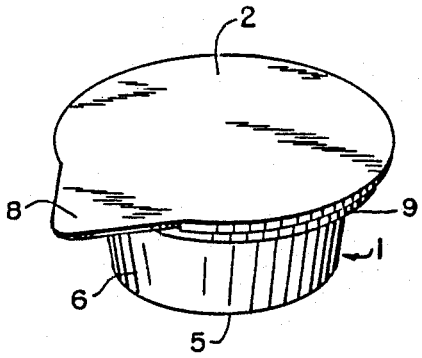
FIG. 1 is a side view in perspective of the cup, with the membrane in a sealed position.
Figure 2:
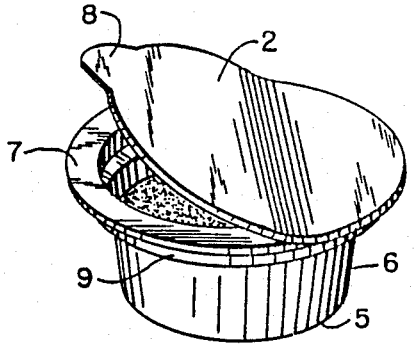
FIG. 2 is a sideview in perspective of the cup, with the membrane in a partially open position.
Figure 3:
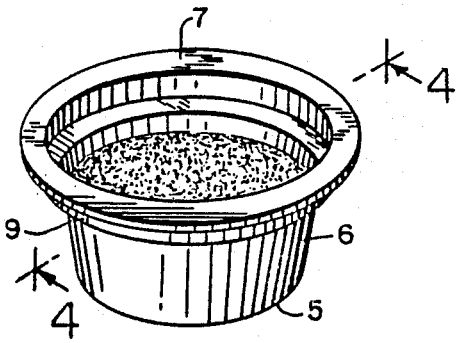
FIG. 3 is a sideview in perspective of the cup, without the membrane.
Figure 4:
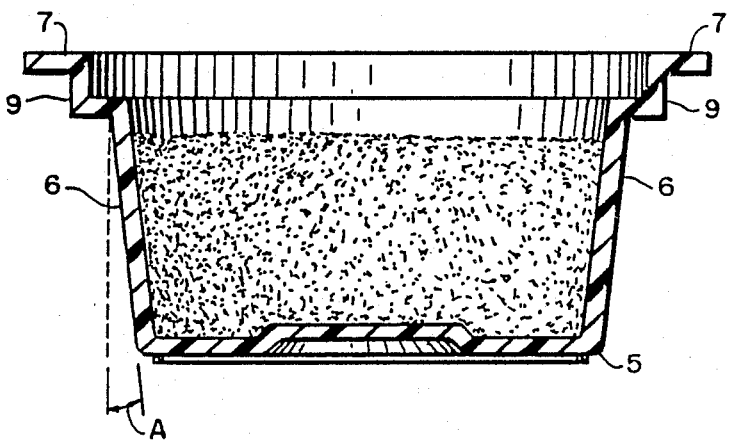
FIG. 4 is a cross-sectional view along line 4—4 of FIG. 3.

Referring to the drawings, a rigid, injection-molded plastic container is designed for easy handling. The container comprises a cup 1 which is covered and heat-sealed to a laminated foil membrane 2. The cup 1 is made from an injection-molded plastic, such as high density polyethelyne or polypropelyne, preferably polyethylene, which forms a sufficient barrier to atmospheric conditions. The cup is comprised of a circular base 5, which may be flat, or may contain various ridges or other characteristics depending upon the future handling and intended use. The base of the cup is attached to an upwardly diverging sidewall 6. The sidewall 6 diverges from the base at an optimal angle 7 from the vertical. The angle has been determined by optimizing the angle which can be easily held within one's grasp while exerting pressure to remove the membrane, in conjuction with the angle which provides for the most cups per unit stack height, and for adequate spacing of the cups, and ease of indexing the cups into the machinery on the assembly line. It has been found that an angle within the range of about 11.5° to about 12.5° facilitates grasping the cup and allows acceptable stackability. An angled 11.8° to 12.2° is preferred, with an optimal angle of about 12.0°. This angle is important as a result of the characteristics of the injection molded plastic. Prior containers exhibited an amount of elasticity or "give" when pressure was applied upon grasping of the container. The rigid, injection-molded cup does not exhibit such characteristics, and if the angle of divergence is too large, the cup will slip or pop from one's grasp as pressure is exerted while removing the membrane 2.

The top of the sidewall is comprised of a flat annular surface 8 which is used as a sealing surface; the contact area for the heat sealing of the cup to the membrane 2.

Figure 5:
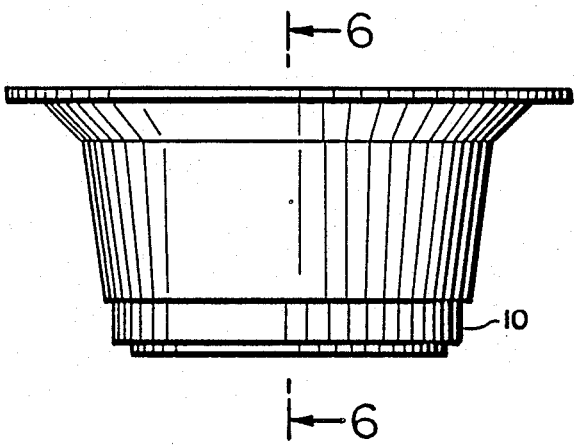
FIG. 5 is a side view in perspective of an alternate embodiment.
Figure 6:
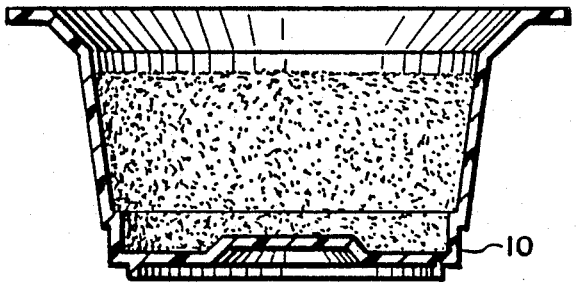
FIG. 6 is a cross-sectional view of an alternate embodiment.

FIGS. 1–4 show a cup with a stacking ring 9 at the top of the sidewall, adjacent to the sealing surface. FIGS. 5 and 6, which are of the preferred embodiment, show the cross-section of a cup with a stacking ring on the bottom of the cup. This is preferable due to the increase in managability on the assembly line. When the cups are indexed, they act as a cone within a cylinder, and center themselves automatically, as opposed to the top-stacking ringed cups, which must be exactly on target.

The membrane 2 forms the cover for the container. It is formed from an impermeable material, preferably a lamination of foil, low density polyethylene and a heat seal coating. The heat seal is formulated to produce good continuous bonds and controlled removal force. This lamination produces a membrane with more elasticity than the materials previously laminated into membranes, or non-laminated foil. The membrane is preferably a lamination of 2 mils of foil, 2 mils of low density polyethylene and the heat seal coating.

The membrane may be slightly larger than the diameter of the opening of the cup so that after heat sealing the membrane to the cup, there is a slight extention of laminated foil which can be folded down around the side of the flat, annular sealing surface on the cup for a more pleasing appearance. In addition, the membrane comprises a tab 9 which extends beyond the flat annular sealing surface, and so provides a means to grasp and pull the membrane. This facilitates breaking the heat seal and removing the membrane from the cup. As previously stated, the ease of peelability of the membrane from the cup depends upon good shear strength and poor tensile strength.

What is claimed is:

1. A container comprising:

a rigid, injection molded, plastic cup, having a circular base attached to an upwardly divergent sidewall, said wall diverging at an angle of from about 11.5° to about 12.5° from the vertical, to facilitate grasping the cup;

a flat annular sealing surface at the top of the sidewall; and an impermeable membrane sealed to the sealing surface, said membrane having a tab which extends beyond the flat annular sealing surface, providing a means to grasp and pull so as to break said seal.

2. A container as set forth in claim 1 where the angle of the sidewall to the vertical is from about 11.8° to about 12.2°.

3. A container as set forth in claim 1 where the angle of the sidewall to the vertical is about 12.0°.

4. A container as set forth in claim 1 where the membrane is a laminate of foil, polyethylene and heat seal coating.

* * * * *